US009764446B2

(12) United States Patent
Aizawa et al.

(10) Patent No.: US 9,764,446 B2
(45) Date of Patent: Sep. 19, 2017

(54) ROTARY JOINT AND POLISHING APPARATUS

(71) Applicant: EBARA CORPORATION, Tokyo (JP)

(72) Inventors: Hideo Aizawa, Tokyo (JP); Tadakazu Sone, Tokyo (JP); Masao Umemoto, Tokyo (JP); Ryuichi Kosuge, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 265 days.

(21) Appl. No.: 14/682,477

(22) Filed: Apr. 9, 2015

(65) Prior Publication Data

US 2015/0290769 A1 Oct. 15, 2015

(30) Foreign Application Priority Data

Apr. 10, 2014 (JP) ..... 2014-081010

(51) Int. Cl.
*B24B 57/02* (2006.01)
*B24B 37/10* (2012.01)

(52) U.S. Cl.
CPC ..... *B24B 57/02* (2013.01); *B24B 37/10* (2013.01); *B24B 37/107* (2013.01)

(58) Field of Classification Search
CPC ..... B24B 5/047; B24B 37/10; B24B 37/102; B24B 37/105; B24B 37/107; B24B 55/02; B24B 55/03; B24B 57/02; F16L 27/08; F16L 37/244
See application file for complete search history.

(56) References Cited

U.S. PATENT DOCUMENTS 5,804,507 A * 9/1998 Perlov ..... B24B 57/02 134/33
6,234,815 B1 * 5/2001 Omiya ..... B24B 37/04 439/191
6,412,822 B1 * 7/2002 Omiya ..... F16L 27/0828 277/937
6,485,062 B2 * 11/2002 Omiya ..... F16L 27/087 285/106
6,508,472 B2 * 1/2003 Omiya ..... F16L 39/04 277/408

(Continued)

FOREIGN PATENT DOCUMENTS

JP 11-257496 A 9/1999
JP 11-325356 A 11/1999
JP 11-336970 A 12/1999

*Primary Examiner* — Timothy V Eley
(74) *Attorney, Agent, or Firm* — Pearne & Gordon LLP

(57) ABSTRACT

The invention suppresses generation of noises attributable to rotation of a rotary joint. A rotary joint includes a rotating body that rotates on a rotating axis A, a housing disposed so as to surround the rotating body, and at least one bearing disposed between the rotating body and the housing and adapted to support rotation of the rotating body. The rotary joint supplies fluids through fluid connection ports formed in the housing and fluid passages formed inside the rotating body to a polishing table having attached thereto a polishing pad for polishing a substrate or a holding portion that is adapted to hold the substrate while pressing the substrate against the polishing pad. At least one elastic member is interposed at least either between the rotating body and the at least one bearing or between the housing and the at least one bearing.

11 Claims, 3 Drawing Sheets

(56) References Cited

U.S. PATENT DOCUMENTS

| | | | | |
|---|---|---|---|---|
| 7,815,194 | B2 * | 10/2010 | Suzuki | F16J 15/3484 277/365 |
| 8,113,545 | B2 * | 2/2012 | Takahashi | F16J 15/3404 277/361 |
| 2013/0113169 | A1 * | 5/2013 | Sugi | H01L 21/6831 279/128 |
| 2016/0258564 | A1 * | 9/2016 | Fukumoto | F16L 39/06 |

* cited by examiner

ROTARY JOINT AND POLISHING APPARATUS

TECHNICAL FIELD

The present invention relates to a rotary joint and a polishing apparatus.

BACKGROUND ART

With the increasing integration and density of semiconductor devices in recent years, circuit wirings are becoming miniaturized, and the number of layers of multilayer wirings is increasing. To miniaturize circuit wirings while increasing the number of layers of multilayer wirings, it is required to accurately planarize the surfaces of semiconductor devices.

A well-known technique for planarizing the surfaces of semiconductor devices is CMP (Chemical Mechanical Polishing). A polishing apparatus for CMP includes a polishing table having a polishing pad attached thereto, and a top ring for holding a material to be polished (for example, a substrate such as a semiconductor wafer or the like, or various films formed on a substrate surface). In the polishing apparatus, the material to be polished is pressed against the polishing pad while the polishing table and the top ring are rotated, to thereby polish the material to be polished.

The polishing apparatus uses a rotary joint to supply fluids to rotating structures, such as the polishing table and the top ring. For example, the rotary joint is used to supply a cooling liquid to the polishing table so as to cool the polishing table. The rotary joint is also used when an optical film thickness sensor is installed inside the polishing table for detecting the film thickness of the material to be polished is detected by the sensor. In this case, the rotary joint is used to supply pure water to the polishing table, so as to surround the optical film thickness sensor with the pure water and thus improve detection accuracy. However, use of the rotary joint is not limited to the above examples. The rotary joint has a variety of other uses as a part of the polishing apparatus.

The rotary joint includes a rotating body that rotates on a rotating axis, a housing disposed so as to surround the rotating body, and a bearing disposed between the rotating body and the housing. The rotary joint supplies fluids to the polishing table or the top ring through fluid connection ports formed in the housing and fluid passages formed inside the rotating body.

CITATION LIST

Patent Literature

Patent Literature 1: Japanese Patent Public Disclosure No. H11-325356

SUMMARY OF INVENTION

Technical Problem

However, in conventional techniques, suppression of generation of noises due to rotation of the rotary joint is not considered.

To be more specific, a bearing is generally installed by fitting between the rotating body and the housing. There are situations, however, where proper fitting is difficult due to problems associated with dimensional tolerances of the bearing, the rotating body and the housing, accuracy in assembly of these parts, and the like. Further, when the rotary joint is used to supply pure water, the rotating body is sometimes formed from resin so as to enable circulation of pure water. In this case, proper fitting becomes difficult due to a creep phenomenon and absolute strength of the resin.

When there is a difficulty in providing a proper fit between the bearing, the rotating body and the housing, a gap can be created between the bearing and the rotating body, or between the bearing and the housing. If that happens, vibrations are generated while the rotary joint rotates. The vibrations are likely to generate noises. The noises may be generated especially when the rotary joint is rotated at relatively low rotational speed.

An object of an embodiment of the present invention is to suppress generation of noises attributable to rotation of the rotary joint.

Solution to Problem

An embodiment of the rotary joint of the present invention has been made, in view of the above-mentioned problem. The embodiment relates to a rotary joint comprising a rotating body adapted to rotate on a rotating axis, a housing disposed so as to surround the rotating body, and at least one bearing disposed between the rotating body and the housing and adapted to support rotation of the rotating body, the rotary joint being capable of supplying fluids through fluid connection ports formed in the housing and fluid passages formed inside the rotating body to a polishing table having attached thereto a polishing pad for polishing a substrate, or a holding portion that is adapted to hold the substrate while pressing the substrate against the polishing pad, wherein at least one elastic member is interposed at least either between the rotating body and the at least one bearing or between the housing and the at least one bearing.

According to another embodiment of the rotary joint, a groove extending along a rotating direction of the rotating body may be formed in an outer surface of the rotating body at a position which is opposed to the at least one bearing. The at least one elastic member may be an O-ring disposed in the groove.

According to still another embodiment of the rotary joint, the rotating body may be a shaft extending along the rotating axis. Fluid passages for circulation of the fluids may be formed inside the shaft so as to extend along the rotating axis.

According to still another embodiment of the rotary joint, fluids including at least pure water may be circulated through the fluid passages. The shaft may be made of resin.

According to still another embodiment of the rotary joint, the at least one bearing comprises a pair of bearings disposed at opposite end portions of the rotating body. Restricting portions may be formed in the housing, the restricting portions being adapted to abut against the pair of bearings to thereby restrict movement of the pair of bearings towards each other along the rotating axis. The rotary joint may further include a pair of flanges disposed at opposite end portions of the housing and adapted to press the pair of bearings against the restricting portions.

A polishing apparatus according to an embodiment of the present invention comprises a polishing table having attached thereto a polishing pad for polishing a substrate, a holding portion adapted to hold the substrate while pressing the substrate against the polishing pad, and the rotary joint of any one of the above embodiments, which is adapted to supply the fluids to the polishing table or the holding portion.

Advantageous Effects of Invention

According to an embodiment of the present invention, generation of noises attributable to rotation of the rotary joint can be suppressed.

DESCRIPTION OF EMBODIMENTS

A rotary joint and a polishing apparatus according to an embodiment of the present invention will be described below with reference to the drawings. First, the polishing apparatus will be explained.

<Polishing Apparatus>

Figure 1:
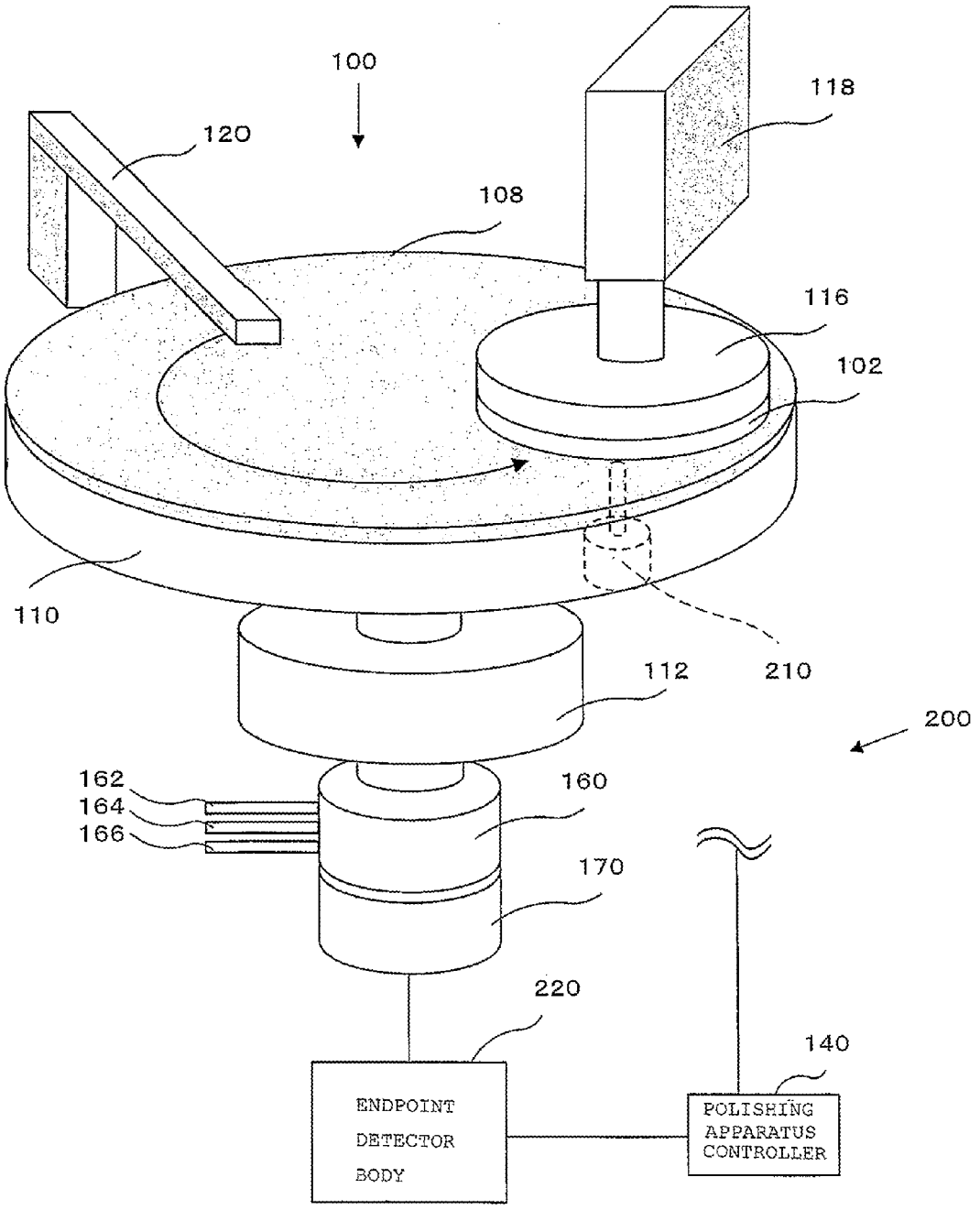
FIG. 1 schematically illustrates an entire configuration of a polishing apparatus.

FIG. 1 schematically illustrates an entire configuration of a polishing apparatus. As illustrated in FIG. 1, a polishing apparatus 100 includes a polishing table 110 with an upper surface capable of having attached thereto a polishing pad 108 for polishing a material 102 to be polished (for example, a substrate such as a semiconductor wafer or the like, or various films formed on the surface of a substrate), a first electric motor 112 that rotatively drives the polishing table 110, a top ring 116 that is capable of holding the material 102 to be polished, and a second electric motor 118 that rotatively drives the top ring 116.

The polishing apparatus 100 further includes a slurry line 120 that supplies a polishing liquid containing an abrasive to an upper surface of the polishing pad 108. The polishing apparatus 100 further includes a polishing apparatus controller 140 that outputs various control signals with respect to the polishing apparatus 100. The polishing apparatus 100 further includes a rotary connector 170 that supplies the polishing table 110 with various electric signals.

The polishing apparatus 100 further includes a rotary joint 160 for supplying the polishing table 110 with chiller water for cooling the polishing table 110 and pure water used for film thickness measurement of an optical film thickness sensor discussed below. Connected to the rotary joint 160 are a chiller water supply pipe 162, a chiller water discharge pipe 166, and a pure water supply pipe 164.

For polishing the material 102 to be polished, the polishing apparatus 100 supplies a polishing slurry containing abrasive grains from the slurry line 120 to the upper surface of the polishing pad 108, and rotatively drives the polishing table 110 by means of the first electric motor 112. The polishing apparatus 100 presses the material 102 to be polished, which is held by the top ring 116, against the polishing pad 108 while the top ring 116 is being rotated on a rotating axis that is offset from the rotating axis of the polishing table 110. The material 102 to be polished is thus polished by the polishing pad 108 holding the polishing slurry, and planarized.

A polishing endpoint detector 200 will now be described. As illustrated in FIG. 1, the polishing endpoint detector 200 includes an optical film thickness sensor 210 and an endpoint detector body 220 connected to the optical film thickness sensor 210 via the rotary joint 160 and the rotary connector 170.

Each of the polishing table 110 and the polishing pad 108 has a hole formed therein, into which the optical film thickness sensor 210 can be inserted from the back side of the polishing table 110. The optical film thickness sensor 210 is inserted into the holes formed in the polishing table 110 and the polishing pad 108. The optical film thickness sensor 210 emits light to the material 102 to be polished, receives a plurality of reflected beams reflected from the material 102 to be polished, and transmits the reflected beams to the endpoint detector body 220.

The endpoint detector body 220 detects a polishing endpoint of the material 102 to be polished, on the basis of transition of signal intensity of a synthetic wave of the reflected beams which are transmitted from the optical film thickness sensor 210. The endpoint detector body 220 is capable of detecting the polishing endpoint of the material 102 to be polished, for example, if a relation between a polishing rate of the material 102 to be polished and a cycle of transition of signal intensity of the synthetic wave is previously known.

The endpoint detector body 220 is connected to the polishing apparatus controller 140 that conducts various controls with respect to the polishing apparatus 100. When the endpoint detector body 220 detects the polishing endpoint of the material 102 to be polished on the basis of transition of signal intensity of the synthetic wave of the reflected beams, the endpoint detector body 220 supplies a signal indicative of the polishing endpoint to the polishing apparatus controller 140. Upon receipt of the signal indicative of the polishing endpoint from the endpoint detector body 220, the polishing apparatus controller 140 ends the polishing performed by the polishing apparatus 100.

<Rotary Joint>

Figure 2A:
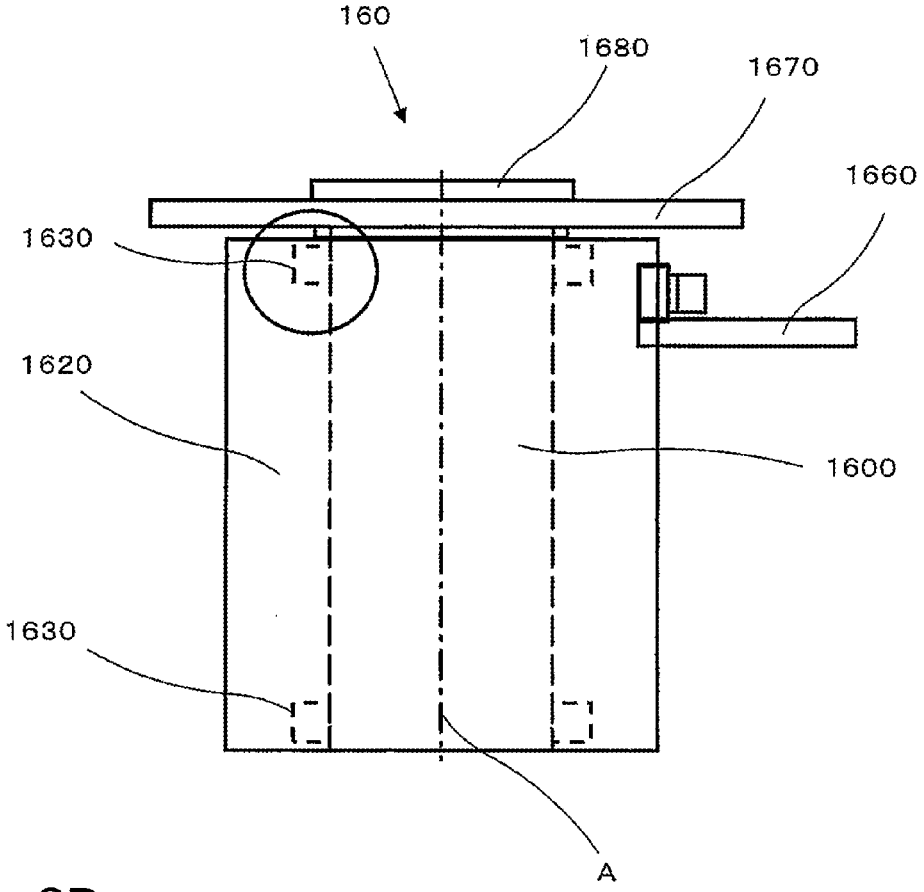
FIG. 2A schematically illustrates a configuration of a rotary joint.
Figure 2B:
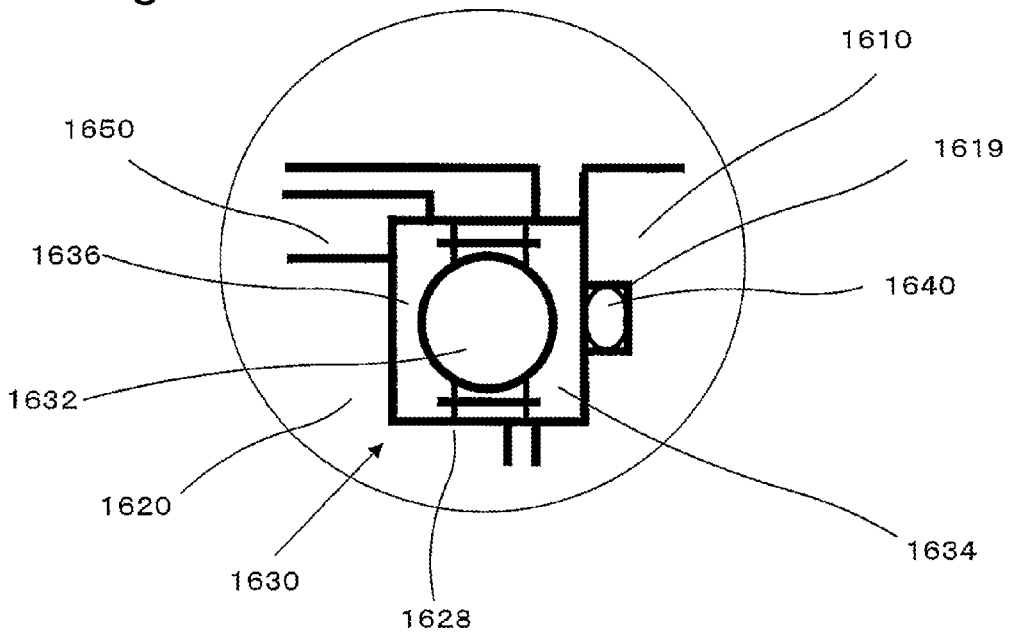
FIG. 2B illustrates a configuration of a bearing of the rotary joint.
Figure 3:
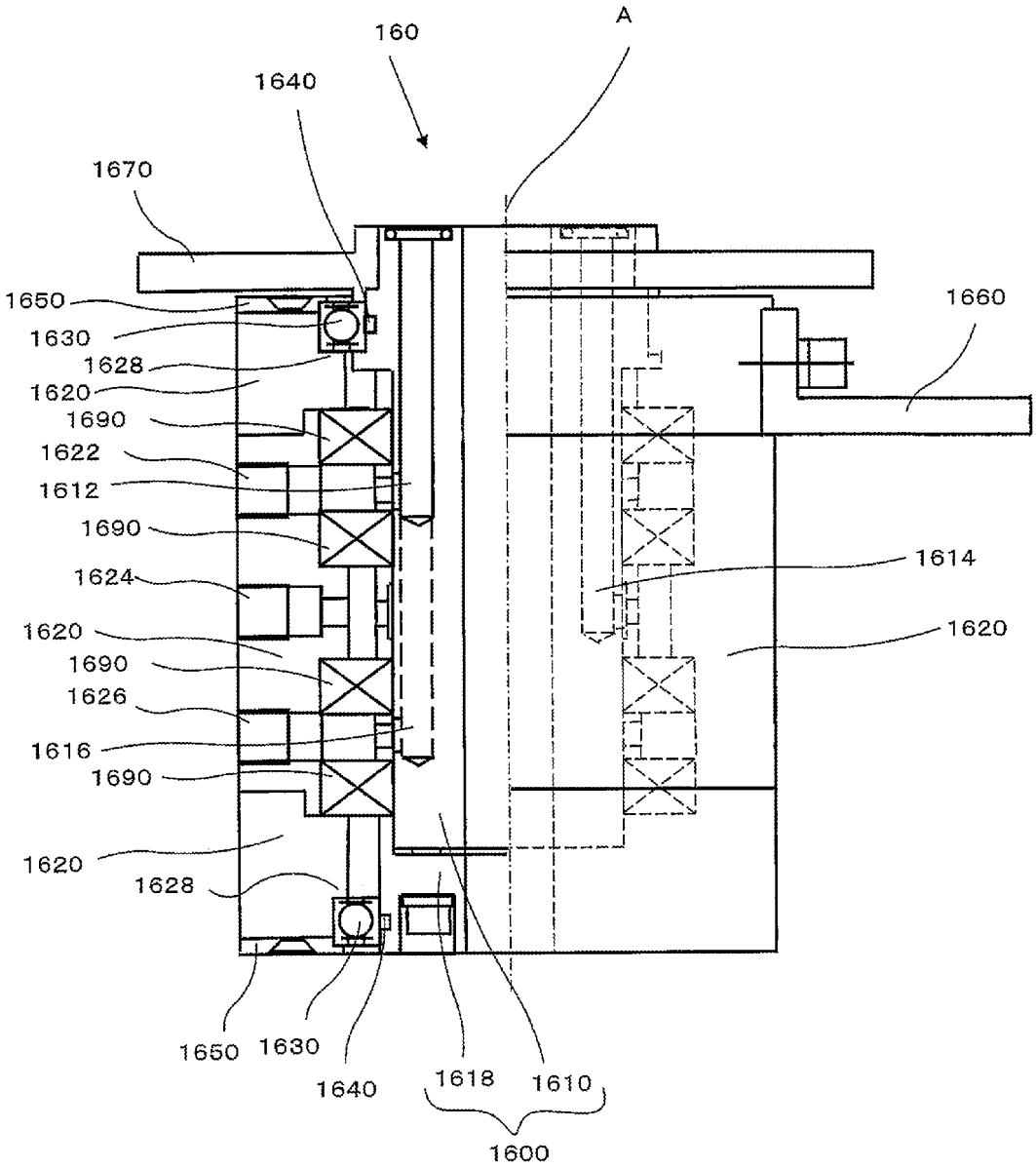
FIG. 3 illustrates details of the configuration of the rotary joint.

The rotary joint 160 will now be described. FIG. 2A schematically illustrates a configuration of the rotary joint. FIG. 2B illustrates a configuration of a bearing of the rotary joint, and is an enlarged view of an encircled portion in FIG. 2A. FIG. 3 illustrates details of the configuration of the rotary joint.

As illustrated in FIGS. 2A, 2B and 3, the rotary joint 160 includes a rotating body 1600 that rotates on an imaginary rotating axis A, a cylindrical housing 1620 disposed so as to surround the rotating body 1600, and bearings 1630 disposed between the rotating body 1600 and the housing 1620. The rotating body 1600 includes a shaft 1610 that extends along the rotating axis A and rotates on the rotating axis A, and a sleeve 1618 fixed to a lower end of the shaft 1610 with a bolt or the like. The housing 1620 is a cylindrical body disposed concentrically with the shaft 1610 and the sleeve 1618. The rotary joint 160 further includes a rotation stopper plate 1660 for restricting rotation of the housing 1620, which is disposed in an outer peripheral portion of the housing 1620.

Formed in the housing 1620 are fluid connection ports 1622 and 1626 for supplying fluids to the polishing table 110. The fluid connection port 1622 is connected to the chiller water supply pipe 162, and the fluid connection port 1626 to the chiller water discharge pipe 166. Further, a fluid connection port 1624 for supplying pure water to the polishing table 110 is formed in the housing 1620. The fluid connection port 1624 is connected to the pure water supply pipe 164. The fluid connection ports 1622, 1624 and 1626 are formed so as to extend through the housing 1620 in a radial direction. The rotary joint 160 includes mechanical seals 1690 disposed in a connection between the fluid connection port 1622 and the chiller water supply pipe 162, and a connection between the fluid connection port 1626 and the chiller water discharge pipe 166. The rotary joint 160 includes another mechanical seal 1690 disposed in a connection between the fluid connection port 1624 and the pure water supply pipe 164. However, the pipe arrangement described herein is only an example, and the pipes may be connected to other connection ports.

The shaft 1610 and the sleeve 1618 extend along the rotating axis A and have a hollow structure. In the hollow portions of the shaft 1610 and the sleeve 1618, there are provided wirings for various signals, which are connected to the polishing table 110. Fluid passages 1612, 1614 and 1616 for fluid circulation are formed inside the shaft 1610 so as to extend along the rotating axis A. For example, the chiller water supplied from the fluid connection port 1622 is supplied through the fluid passage 1612 to the polishing table 110. After passing the polishing table 110, the chiller water flows through the fluid passage 1616 and is discharged from the fluid connection port 1626. The pure water supplied from the fluid connection port 1624 is supplied through the fluid passage 1614 to the polishing table 110 (the hole in which the optical film thickness sensor 210 is disposed). Since the fluids including pure water are circulated through the fluid passage 1614, the shaft 1610 is made of resin.

The rotary joint 160 is capable of supplying the fluids to the polishing table 110 through the fluid connection ports 1622, 1624 and 1626 formed in the housing 1620 and the fluid passages 1612, 1614 and 1616 formed inside the shaft 1610. Although the present embodiment discusses the rotary joint 160, which supplies the fluids to the polishing table 110, the embodiment is not limited to the rotary joint 160. For example, a similar configuration may be applied to a rotary joint that supplies fluids to the top ring 116.

<Bearing and elastic member>

The bearings 1630 are, for example, a pair of ring-shaped ball bearings, which are disposed at opposite end portions of the rotating body 1600 (namely, the shaft 1610 and the sleeve 1618). To be specific, the bearing 1630 located close to the polishing table 110 is disposed at the end portion of the shaft 1610 which is located close to the polishing table 110. The bearing 1630 located close to the rotary connector 170 is disposed at the end portion of the sleeve 1618 which is located close to the rotary connector 170. The bearing 1630 includes an inner race 1634 formed in a shape like a ring, an outer race 1636 formed in a shape like a ring with a larger diameter than the inner race 1634, and a plurality of balls 1632 interposed between the inner and outer races 1634 and 1636.

According to the present embodiment, elastic members 1640 are interposed at least either between the rotating body 1600 and the bearing 1630 or between the housing 1620 and the bearing 1630. Specifically, in the present embodiment, the elastic members 1640 are interposed between the shaft 1610 and the bearing 1630, and between the sleeve 1618 and the bearing 1630. More specifically, the elastic members 1640 are interposed between the inner race 1634 of the bearing 1630 and an outer surface of the shaft 1610, and between the inner race 1634 of the bearing 1630 and an outer surface of the sleeve 1618.

A groove 1619 is formed in the outer surface of the shaft 1610 at a position which is opposed to the bearing 1630, so as to extend along a rotating direction of the shaft 1610. In the same fashion, another groove 1619 is formed in the outer surface of the sleeve 1618 at a position which is opposed to the bearing 1630, so as to extend along a rotating direction of the sleeve 1618. The elastic members 1640 may be O-rings disposed in the grooves 1619. The elastic members 1640 are not limited to the O-rings but are only required to have elasticity.

The present embodiment describes an example in which the elastic members 1640 are interposed between the inner race 1634 of the bearing 1630 and the outer surface of the rotating body 1600. However, this does not limit the present embodiment. The elastic members 1640 may be interposed, for example, between the outer race 1636 of the bearing 1630 and an inner surface of the housing 1620. Alternatively, the elastic members 1640 may be interposed both between the inner race 1634 of the bearing 1630 and the outer surface of the rotating body 1600 and between the outer race 1636 of the bearing 1630 and the inner surface of the housing 1620.

<Flange>

Formed in the housing 1620 are restricting portions 1628 that are brought into abutment with the pair of bearings 1630 to thereby restrict movement of the pair of bearings 1630 towards each other along the rotating axis A. To be more specific, an inner circumferential corner of each end portion of the cylindrical housing 1620 is cut into a rectangular shape, into which the outer race 1636 of the bearing 1630 is fitted. As a result of this cutting, the housing 1620 includes a lateral surface which abuts against an outer peripheral surface of the outer race 1636 of the bearing 1630 and a bottom surface which abuts against a bottom surface of the outer race 1636 of the bearing 1630. The restricting portions 1628 correspond to the bottom surfaces formed by the above-described cutting of the housing 1620.

The rotary joint 160 includes a pair of flanges 1650 disposed at opposite end portions of the housing 1620 and adapted to press the pair of bearings 1630 against the restricting portions 1628. The flanges 1650 are, for example, threadably or otherwise fixed to both end portions of the housing 1620 and press the pair of bearings 1630 against the restricting portions 1628. By way of example, the flange 1650 located close to the polishing table 110 may press the bearing 1630 against the corresponding restricting portion 1628 so that a value of interference of the outer race 1636 of the bearing 1630 in a direction of the rotating axis A ranges from 0.15 to 0.5 mm. Further, by way of example, the flange 1650 located close to the rotary connector 170 may press the bearing 1630 against the corresponding restricting portion 1628 so that a value of interference of the outer race 1636 of the bearing 1630 in the direction of the rotating axis A ranges from 0.05 to 0.5 mm. However, these values of interference are only examples, and may be other values.

The rotary joint 160 of the present embodiment can suppress generation of noises due to rotation of the rotary joint 160. The bearing 1630 is generally installed by being fitted between the rotating body 1600 and the housing 1620. According to conventional art, however, there are situations where proper fitting is difficult due to problems associated with dimensional tolerances of the bearings 1630, the rotating body 1600 and the housing 1620, accuracy in assembly of these parts, and the like. When the rotary joint 160 is used to supply pure water as in the present embodiment, the shaft 1610 of the rotating body 1600 is formed from resin so as to allow circulation of pure water. In this case, proper fitting may become difficult due to a creep phenomenon and absolute strength of the resin.

When there is a difficulty in providing a proper fit between the bearing 1630, the rotating body 1600 and the housing 1620, a gap can be created between the bearing 1630 and the rotating body 1600 or between the bearing 1630 and the housing 1620. If that happens, vibrations are generated while the rotary joint 160 rotates. The vibrations are likely to generate noises. The noises can be generated especially when the rotary joint 160 is rotated at relatively low rotational speed.

To solve the above problem, the present embodiment provides O-rings as the elastic members 1640 between the rotating body 1600 and the bearing 1630. The elastic members 1640 are elastically deformed according to a gap between the bearing 1630 and the rotating body 1600 and a gap between the bearing 1630 and the housing 1620. Therefore, the gap between the bearing 1630 and the rotating body 1600 and the gap between the bearing 1630 and the housing 1620 are absorbed by the elastic members 1640. The present embodiment therefore suppresses vibrations during rotation of the rotary joint 160 and thus suppresses generation of noises attributable to rotation of the rotary joint 160.

In addition, according to the present embodiment, since the pair of bearings 1630 are pressed against the restricting portions 1628 by the pair of flanges 1650, vibrations are suppressed while the rotary joint 160 rotates. The present embodiment thus suppresses generation of noises attributable to rotation of the rotary joint 160.

REFERENCE SIGND LIST

100 polishing apparatus
102 material to be polished
108 polishing pad
110 polishing table
116 top ring
160 rotary joint
162 chiller water supply pipe
164 pure water supply pipe
166 chiller water discharge pipe
210 optical film thickness sensor
1600 rotating body
1610 shaft
1612, 1614, 1616 fluid passage
1618 sleeve
1619 groove
1620 housing
1622, 1624, 1626 fluid connection port
1628 restricting portion
1630 bearing
1632 ball
1634 inner race
1636 outer race
1640 elastic member (O-ring)
1650 flange
1690 mechanical seal
A rotating axis

What is claimed is:

1. A rotary joint comprising:

a rotating body adapted to rotate on a rotating axis;

a housing disposed so as to surround the rotating body; and at least one bearing disposed between the rotating body and the housing and adapted to support rotation of the rotating body, the rotary joint being capable of supplying fluids through fluid passages formed inside the rotating body to a polishing table having attached thereto a polishing pad for polishing a substrate, or a holding portion that is adapted to hold the substrate while pressing the substrate against the polishing pad, wherein at least one elastic member is interposed at least either between the rotating body and the at least one bearing or between the housing and the at least one bearing, wherein a groove extending along a rotating direction of the rotating body is formed in an outer surface of the rotating body at a position which is opposed to the at least one bearing; and the at least one elastic member is an O-ring disposed in the groove.

2. The rotary joint according to claim 1, wherein the rotating body is a shaft extending along the rotating axis; and fluid passages for circulation of the fluids are formed inside the shaft so as to extend along the rotating axis.

3. The rotary joint according to claim 2, wherein fluids including at least pure water are circulated through the fluid passages; and the shaft is made of resin.

4. The rotary joint according to claim 3, wherein the at least one bearing comprises a pair of bearings disposed at opposite end portions of the rotating body;

restricting portions are formed in the housing, the restricting portions being adapted to abut against the pair of bearings to thereby restrict movement of the pair of bearings towards each other along the rotating axis; and the rotary joint further comprises a pair of flanges disposed at opposite end portions of the housing and adapted to press the pair of bearings against the restricting portions.

5. The rotary joint according to claim 1, wherein the at least one bearing comprises a pair of bearings disposed at opposite end portions of the rotating body;

restricting portions are formed in the housing, the restricting portions being adapted to abut against the pair of bearings to thereby restrict movement of the pair of bearings towards each other along the rotating axis; and the rotary joint further comprises a pair of flanges disposed at opposite end portions of the housing and adapted to press the pair of bearings against the restricting portions.

6. A polishing apparatus comprising:

a polishing table having attached thereto a polishing pad for polishing a substrate;

a holding portion adapted to hold the substrate while pressing the substrate against the polishing pad; and a rotary joint adapted to supply fluids to the polishing table or the holding portion, the rotary joint comprising:

a rotating body adapted to rotate on a rotating axis;

a housing disposed so as to surround the rotating body; and at least one bearing disposed between the rotating body and the housing and adapted to support rotation of the rotating body, the rotary joint being capable of supplying fluids through fluid passages formed inside the rotating body to the polishing table or the holding portion, wherein at least one elastic member is interposed at least either between the rotating body and the at least one bearing or between the housing and the at least one bearing, wherein a groove extending along a rotating direction of the rotating body is formed in an outer surface of the rotating body at a position which is opposed to the at least one bearing; and the at least one elastic member is an O-ring disposed in the groove.

7. The polishing apparatus according to claim 6, wherein the rotating body is a shaft extending along the rotating axis; and fluid passages for circulation of the fluids are formed inside the shaft so as to extend along the rotating axis.

8. The polishing apparatus according to claim 7, wherein fluids including at least pure water are circulated through the fluid passages; and the shaft is made of resin.

9. The polishing apparatus according to claim 8, wherein the at least one bearing comprises a pair of bearings disposed at opposite end portions of the rotating body;

restricting portions are formed in the housing, the restricting portions being adapted to abut against the pair of bearings to thereby restrict movement of the pair of bearings towards each other along the rotating axis; and the rotary joint further comprises a pair of flanges disposed at opposite end portions of the housing and adapted to press the pair of bearings against the restricting portions.

10. The polishing apparatus according to claim 7, wherein the at least one bearing comprises a pair of bearings disposed at opposite end portions of the rotating body;

restricting portions are formed in the housing, the restricting portions being adapted to abut against the pair of bearings to thereby restrict movement of the pair of bearings towards each other along the rotating axis; and the rotary joint further comprises a pair of flanges disposed at opposite end portions of the housing and adapted to press the pair of bearings against the restricting portions.

11. The polishing apparatus according to claim 6, wherein the at least one bearing comprises a pair of bearings disposed at opposite end portions of the rotating body;

restricting portions are formed in the housing, the restricting portions being adapted to abut against the pair of bearings to thereby restrict movement of the pair of bearings towards each other along the rotating axis; and the rotary joint further comprises a pair of flanges disposed at opposite end portions of the housing and adapted to press the pair of bearings against the restricting portions.

* * * * *